US010513848B2

(12) United States Patent
Faigen

(10) Patent No.: US 10,513,848 B2
(45) Date of Patent: Dec. 24, 2019

(54) BUILDING COMPONENT

(71) Applicant: Philip David Faigen, Ardross (AU)

(72) Inventor: Philip David Faigen, Ardross (AU)

( * ) Notice: Subject to any disclaimer, the term of this patent is extended or adjusted under 35 U.S.C. 154(b) by 725 days.

(21) Appl. No.: 14/905,285

(22) PCT Filed: Mar. 6, 2014

(86) PCT No.: PCT/AU2014/000216
§ 371 (c)(1),
(2) Date: Jan. 14, 2016

(87) PCT Pub. No.: WO2014/134678
PCT Pub. Date: Sep. 12, 2014

(65) Prior Publication Data

US 2016/0194876 A1 Jul. 7, 2016

(30) Foreign Application Priority Data

Mar. 6, 2013 (AU) ..... 2013900773

(51) Int. Cl.
*E04B 5/02* (2006.01)
*E04B 7/20* (2006.01)
(Continued)

(52) U.S. Cl.
CPC ..... *E04C 2/50* (2013.01); *E04B 1/04* (2013.01); *E04B 1/64* (2013.01); *E04B 2/26* (2013.01); *E04B 5/04* (2013.01); *E04B 5/36* (2013.01); *E04B 5/48* (2013.01); *E04B 7/20* (2013.01); *E04C 2/46* (2013.01); *E04C 2/528* (2013.01);
(Continued)

(58) Field of Classification Search
CPC ... E04C 2/46; E04C 2/528; E04C 2/04; E04C 2/044; E04C 2/049; E04C 2/34; E04C 2/382; E04C 2/521; E04C 1/397; E04B 1/04; E04B 1/64; E04B 1/7038;
(Continued)

(56) References Cited

U.S. PATENT DOCUMENTS 1,420,246 A * 6/1922 Faber ..... E04C 2/044 52/572
1,834,892 A * 12/1931 Betzler ..... E04B 1/04 52/284
(Continued)

OTHER PUBLICATIONS

International Preliminary Report on Patentability issued in corresponding application No. PCT/AU2014/000216 dated Jun. 24, 2015.
(Continued)

*Primary Examiner* — Ryan D Kwiecinski
*Assistant Examiner* — Matthew J Gitlin
(74) *Attorney, Agent, or Firm* — Foley & Lardner LLP

(57) ABSTRACT

A building component has first and second parallel and spaced apart edges, a first panel portion and first and second members. The first and second members are located on the same side of the first panel portion. The members extend along the first and second edges. A second panel portion is demountably connected to the first panel portion in a face to face relationship. This creates a plurality of cavities within the building component. A plurality of holes is formed in the component to enable passage of services such as electricity, gas and water through the component.

6 Claims, 8 Drawing Sheets

(51) Int. Cl.

| | |
|---|---|
| ***E04B 5/04*** | (2006.01) |
| ***E04B 5/36*** | (2006.01) |
| ***E04B 5/48*** | (2006.01) |
| ***E04B 1/04*** | (2006.01) |
| ***E04F 10/08*** | (2006.01) |
| ***E04F 10/10*** | (2006.01) |
| ***E06B 9/04*** | (2006.01) |
| ***E04B 2/26*** | (2006.01) |
| ***E04B 1/64*** | (2006.01) |
| ***E04B 2/00*** | (2006.01) |
| ***E04C 2/52*** | (2006.01) |
| ***E04D 13/00*** | (2006.01) |
| *E06B 9/00* | (2006.01) |

(52) U.S. Cl.
CPC ..... *E04D 13/00* (2013.01); *E04F 10/08* (2013.01); *E04F 10/10* (2013.01); *E06B 9/04* (2013.01); *E06B 2009/005* (2013.01)

(58) Field of Classification Search
CPC ..... E04B 2103/02; E04B 5/48; E04B 5/36; E04F 10/08
USPC ..... 52/251, 602, 601, 403.1, 600, 250, 414, 52/309.12, 309.17, 405.1
See application file for complete search history.

(56) References Cited

U.S. PATENT DOCUMENTS 2,071,039 A * 2/1937 Leemhuis ..... E04B 2/28 52/563
2,184,464 A * 12/1939 Myers ..... E04C 2/044 52/284
2,652,713 A * 9/1953 Senglar ..... E04B 1/04 52/220.2
2,883,852 A * 4/1959 Midby ..... E04B 1/04 52/236.8
3,449,879 A * 6/1969 Bloom ..... E04B 1/04 52/235
3,475,529 A 10/1969 Lacy
3,511,005 A * 5/1970 MacMaster ..... E04B 2/704 52/282.1
3,740,909 A * 6/1973 Stinnes ..... E04B 1/70 52/302.1
4,056,910 A * 11/1977 Hiatt ..... E04C 2/041 52/309.1
5,177,917 A 1/1993 Del Castillo Von Haucke
5,317,848 A * 6/1994 Abbey ..... E04C 2/04 52/284
5,373,676 A * 12/1994 Francis ..... E04F 13/0862 52/386
5,396,750 A * 3/1995 Kleyn ..... E04C 2/20 52/792.11
5,493,838 A * 2/1996 Ross ..... E02D 29/05 405/229
5,804,763 A 9/1998 Smeenge
5,950,390 A 9/1999 Jones
5,953,864 A * 9/1999 Beck ..... E04B 1/0007 403/DIG. 12
6,145,261 A * 11/2000 Godfrey ..... E04D 11/00 52/302.1
6,260,320 B1 * 7/2001 Di Lorenzo ..... E04B 1/04 52/250
6,427,406 B1 * 8/2002 Weaver ..... B28B 19/003 52/251
6,427,407 B1 8/2002 Wilson
6,698,150 B1 * 3/2004 DiLorenzo ..... E01F 8/0029 52/250
6,848,232 B2 2/2005 Pulte et al.
7,530,203 B1 * 5/2009 Hare ..... B28B 19/003 52/250
7,790,302 B2 * 9/2010 Ladely (Guevara) .. E04B 5/043 106/778
8,225,564 B2 * 7/2012 Sanchez ..... E04B 1/04 52/223.7
8,590,215 B2 * 11/2013 Damichey ..... E04C 2/382 52/284
9,249,572 B2 * 2/2016 Neumayr ..... E04C 2/3405
9,624,666 B2 * 4/2017 Singleton ..... E04C 2/284
2001/0001514 A1 * 5/2001 Kistner ..... E04C 2/044 264/276
2005/0188649 A1 9/2005 Hagen
2009/0049776 A1 * 2/2009 Lim ..... E04C 2/06 52/223.7
2009/0049778 A1 2/2009 Kralic et al.
2009/0205277 A1 * 8/2009 Gibson ..... E04B 7/22 52/309.9
2010/0180527 A1 * 7/2010 Kim ..... E04C 1/40 52/309.13
2011/0173925 A1 7/2011 Brown
2016/0153191 A1 * 6/2016 Henderson ..... E04C 2/46 52/220.2
2017/0009449 A1 * 1/2017 Leen ..... E04F 13/0869
2017/0268232 A1 * 9/2017 Renke ..... E04C 2/26
2017/0298622 A1 * 10/2017 McManus ..... E04B 5/023
2017/0298627 A1 * 10/2017 VanHoose ..... E04C 2/288
2018/0038103 A1 * 2/2018 Neumayr ..... E04B 1/14

OTHER PUBLICATIONS

International Search Report issued in PCT/AU2014/000216 dated May 5, 2014.

* cited by examiner

BUILDING COMPONENT

CROSS REFERENCE TO RELATED APPLICATIONS

The present application is a U.S. National Stage of International Application No. PCT/AU2014/000216 filed on Mar. 6, 2014, which claims the benefit of Australian Patent Application No. 2013900773 filed on Mar. 6, 2013, the entire disclosures of all of which are incorporated herein by reference.

TECHNICAL FIELD

A building component is disclosed. The building component may take the form of a wall, floor or roof panel for a building. The disclosed building component facilitates a modular construction process for an associated building.

BACKGROUND ART

There are several well-known techniques for the construction of a building and in particular residential buildings. One technique utilises bricks and mortar to construct walls of the building. The walls typically are founded on a concrete pad and footing. A roof is constructed by first erecting a roof frame on top of the walls and subsequently cladding the frame with a roof covering such as tiles or metal sheets.

Another building technique comprises constructing a frame work from timber or a metal such as steel or aluminium, and subsequently cladding the frame to form walls of the building and subsequently a roof. The frame may be founded on a concrete pad and of footings; or framed above the ground on timber or steel stumps or posts.

Both of the above described building techniques are relatively slow and labour intensive. As a consequence the labour costs in construction are relatively high. Further buildings constructed with the above mentioned materials and techniques are generally not suited, at least without additional and costly engineering, to withstand extreme weather conditions or natural disasters.

The above references to the background art do not constitute an admission that the art forms a part of the common general knowledge of a person of ordinary skill in the art. Further the above references are not intended to limit the application of the building components as disclosed herein. For example embodiments of the building components may be utilised in commercial or industrial building.

SUMMARY OF THE DISCLOSURE

One of the general ideas or concepts behind the presently disclosed building component is to provide a component having a basic structure that can form the basis of either a wall panel, roof panel or floor panel. Thus the building component can be a panel like component. In a broad sense the building component has first and second parallel and spaced apart edges and a first panel portion with first and second opposite sides. First and second members are located on the second side of the first panel portion and extend along the first and second edges respectively. The members may be hollow or may be solid. This is dependent on the load bearing requirements for the building component. For example if the building component were a wall panel for a single storey domestic building, then the members may be hollow. However if the building component is used as a wall panel used to construct a wall of a two or more storey building then the members may be solid so as to provide a greater load bearing capacity. Similarly, in the event that the building component is formed as a floor panel then at least one of the members may be solid particularly in the event that the member forms a footing of the building and is therefore subjected to direct loading from the walls of the building.

A further general idea behind the building component is to form the components from the same material. A material in some embodiments comprises a light weight fibre reinforced cementitious product. One example of such a product is glass reinforced concrete ("GRC").

Embodiments of the building component may be provided with holes to facilitate the passage of services or articles including but not limited to conduits, cables through the component in a plane parallel to the first panel portion. This enables for example services such as water, electricity and gas to be easily channelled through the building components to any room or area in a building constructed from the building components. The holes may also receive tensioning cable for coupling mutually adjacent components together. These cables can be tensioned to provide structural integrity to the mutually adjacent components.

Some embodiments of the building components are closed by the provision of a second panel portion that demountably connects in a face to face relationship with the first panel portion. Such a construction leads to the creation of one or more cavities inside of the building component disposed between the first and second panel portions and the first and second members. The provision of the second demountable panel portion enables access to the inside of the building component for example for the installation and/or repair of services and/or conduits bearing the same. In addition the demountable nature of the second panel portion enables if necessary the opening of the building component to facilitate rapid drying in the event of ingress of substantial volumes of water or other liquid.

Various forms of the building component are provided with complimentary coupling parts to facilitate coupling of adjacent building components. This may include building components of different type, for example a wall panel to a floor panel, or a wall panel to a roof panel. In one example the coupling parts may comprise a tongue along one edge and a groove along an opposite edge.

The building components may be formed with a dimension equal to the dimension of a portion of the building to which the components pertain. For example a wall panel may be formed with a height dimension equal to the height of a wall of a single storey building. Similarly, a floor panel may be formed of a length equal to a distance or a span between load bearing walls of the building. Similarly roof panels may be formed of a dimension so as to bear on spaced apart load bearing walls of an associated building.

In a first aspect there is disclosed a building component comprising first and second parallel and spaced apart edges;

- a first panel portion having first and second opposite sides; and
- at least first and second members each located on the second side of the first panel portion wherein the first and second members extend along the first and second edges respectively.

A building component of this basic form may be used as a base component of a wall panel, roof panel or floor panel.

In one embodiment the building component comprises a plurality of holes located to enable passage of a service or article through the component in a plane generally parallel to the first panel portion. The services may include for example electricity, water or gas. Thus the passage of the service may involve the provision of pipes, conduits, cables or wires to enable the flow of services such as water, gas and electricity. Other articles can pass through the holes in the panels such as for example optical cables, tensioning cables for coupling components together, drain pipes, or heating/cooling conduits or elements.

In one embodiment at least one of the first and second members is hollow.

However in the same or an alternate embodiment at least one of the members is solid.

In one embodiment the building component comprises first and second end walls that extend between and located at opposite ends of the first and second members.

In one embodiment the building component comprises at least one additional member disposed between the first and second members. In this embodiment the at least one additional member may have the same exterior configuration as the first and second members. Yet in an alternate embodiment the at least one additional member may have a different exterior configuration. Indeed the first and second members may have mutually different exterior. In one example the at least one additional member comprises a rib extending parallel to the first and second members.

The building component may comprise a second panel portion demountably coupled to the first panel portion in a face to face relationship on the second side of the first panel portion. In this embodiment the building component comprises one or more cavities located between the first and second panel portions and the first and second members. When the building component is in the form of a roof panel, the building component may comprise channels at opposite ends of the roof panel to facilitate a flow of liquid through the roof panel or between adjacent roof panels. In this embodiment the roof panel may comprise one or more discharge openings in fluid communication with the conduits to enable discharge of liquid flowing through the conduits from the roof panel.

According to a second aspect there is disclosed a building component comprising:

- a first panel portion having first and second opposite sides and at least first and second members located on the second side of the first panel portion, the first and second members extending along the first and second edges of the building component; and
- a second panel portion being releasably coupled on the second side of and in face to face relationship with the first panel portion.

According to a third aspect there is disclosed an awning capable of providing shade to a portion of a building surface, the awning comprising:

- a frame and at least one shade member attached to the frame;
- wherein the at least one shade member is pivotally attached to the frame and selectively movable between a shading position wherein the at least one shade member is supported by the frame at a location angularly displaced from the portion of the building surface and a protecting position where the at least one member overlies in substantial parallel relationship with the portion of the building surface.

In one embodiment each shade member comprises a peripheral frame and a plurality of louvers each of which is pivotally supported in the peripheral frame. In one embodiment the louvers are arranged so that when a corresponding shade member is in the shading position the louvers hang in respective planes substantially parallel to each other and are spaced apart to enable light to pass there between; and when in the protecting position are arranged one above the other and in a mutually overlapping relationship such that an upper end of one louver overlies a lower end of an immediately higher louver.

In one embodiment the awning comprises a latching system arranged to releasably latch the one or more shade members in the shading position. In this embodiment the awning comprises a release system arranged to release the latch thereby allowing the one or more shade members to move from the shading position to the protecting position. The release system may comprise a manually activated release mechanism, an electronically activated release mechanism or a combination of both. In one embodiment the awning may further comprise a momentum dampened hinge coupling each shade member to the frame and operable to dampen momentum of an associated shade member when released from the shading position and moving to the protecting position.

BRIEF DESCRIPTION OF THE DRAWINGS

Notwithstanding any other forms which may fall within the scope of the building component and awning as set forth in the Summary, specific embodiments will now be described, by way of example only, with reference to the accompanying drawings in which.

DETAILED DESCRIPTION OF SPECIFIC EMBODIMENTS

In the accompanying drawings various embodiments of the building component are depicted. The reference number 10 is used to generically denote the various embodiments of the building component. However different specific embodiments are denoted with an additional letter suffix, "w", "f" or "r" to signify a wall panel, floor panel and roof panel embodiments of the building component respectively. Notwithstanding the different specific embodiments in the following description the same reference numbers are used to denote features having the same or substantially same structure or function.

Figure 1:
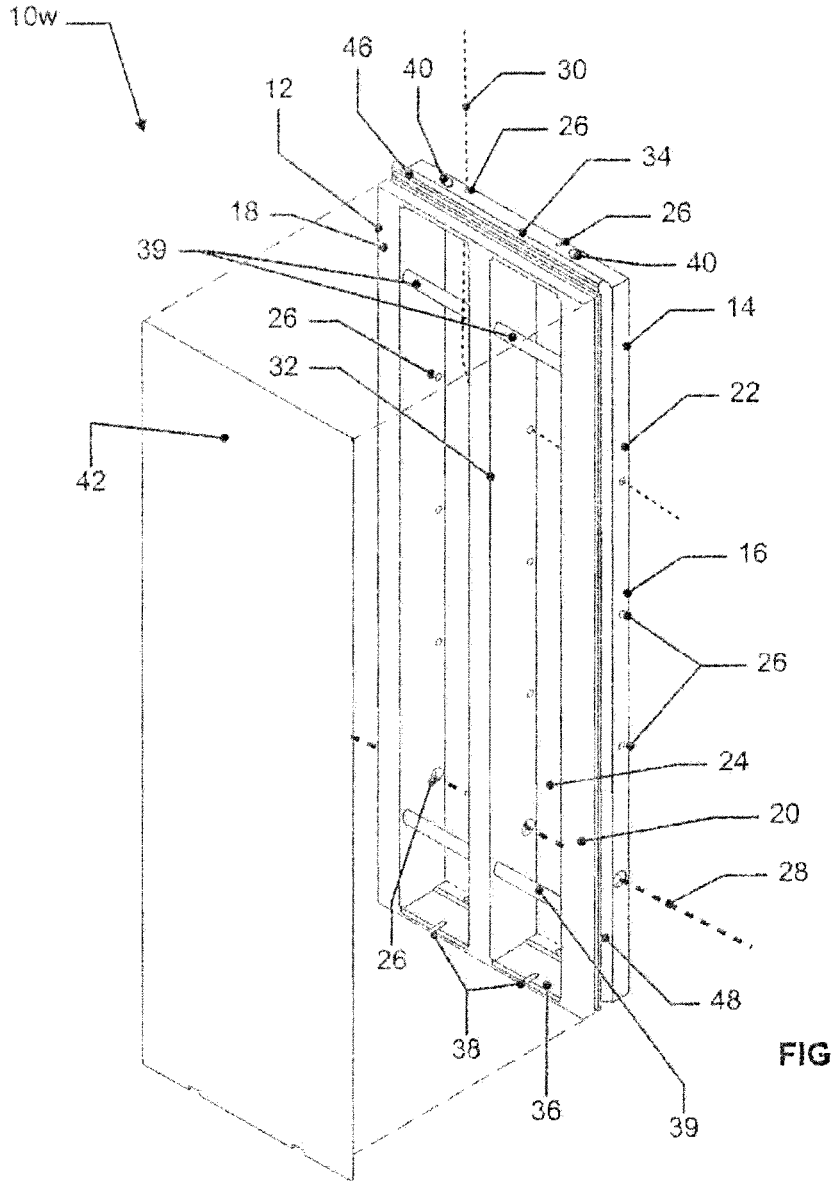
FIG. 1 is an exploded perspective view of a first embodiment of the disclosed building component, the first embodiment being in the form of a wall panel.
Figure 2:
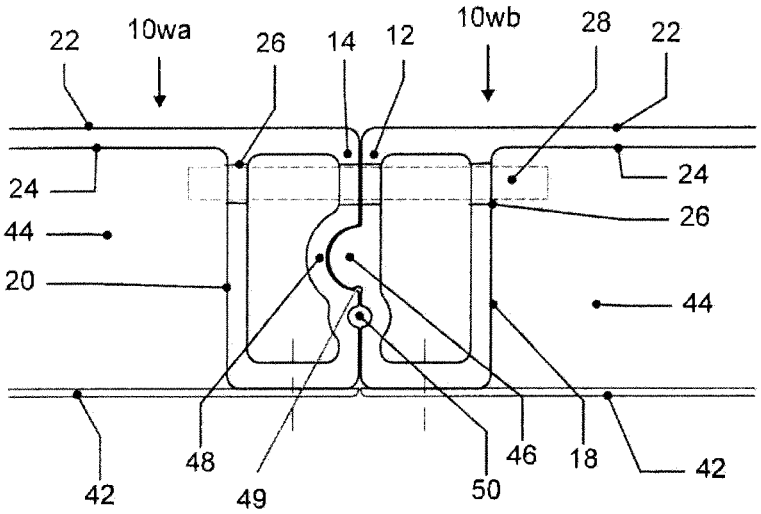
FIG. 2 is a section view of two wall panels of the type shown in FIG. 1 joined end to end.
Figure 3:
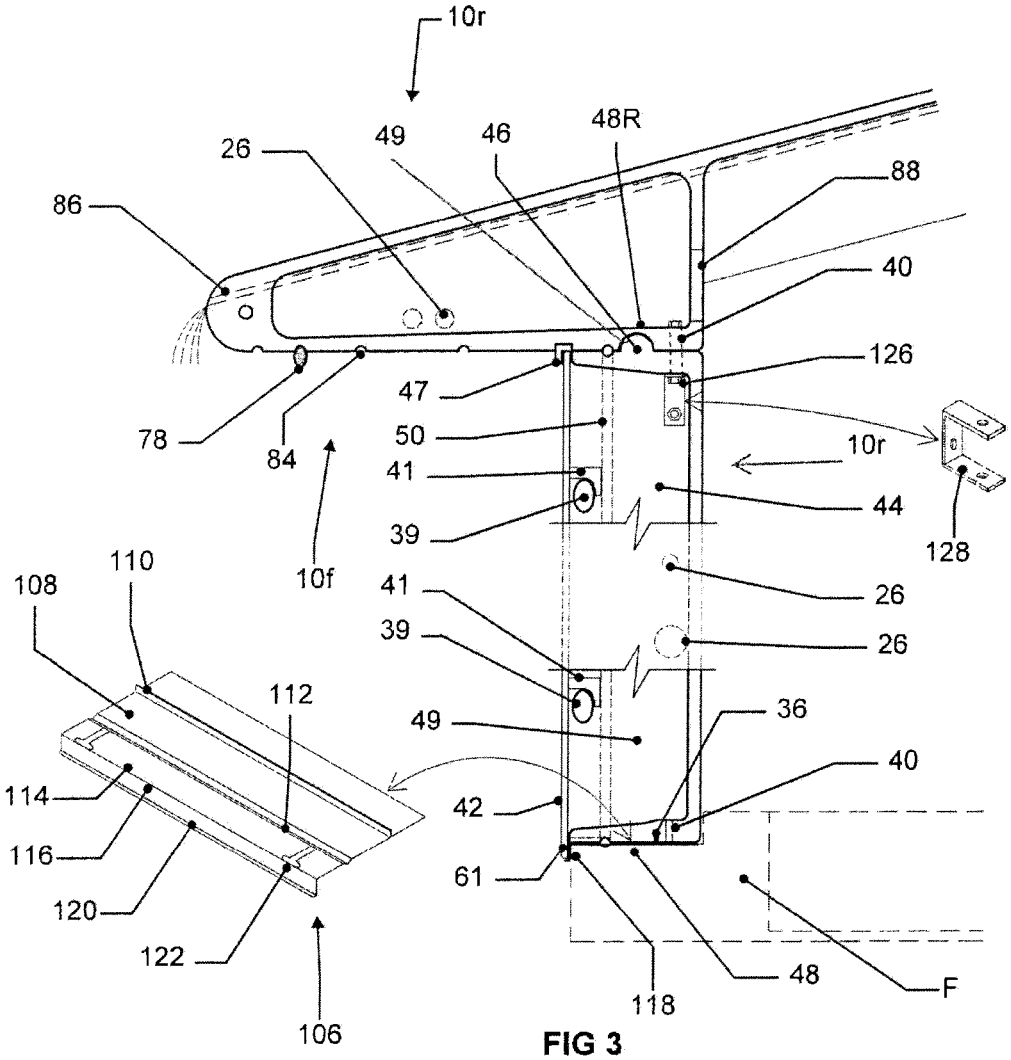
FIG. 3 is a section view from the side of a portion of a building constructed using a plurality of wall panels in accordance with that shown in FIG. 1 and a second embodiment of the building component in the form of a roof panel.

FIGS. 1-3 illustrate a first embodiment of a building component 10*w* that can function as a wall panel. The building component 10*w* has first and second parallel and spaced part edges 12 and 14; a first panel portion 16, and the first and second members 18 and 20.

The first panel portion 16 has a first side 22 and an opposite second side 24. The first and second members 18 and 20 are located on the second side 24 of the first panel portion 16. Further, the first and second members 18 and 20 extend along the first and second edges 12 and 14 respectively. The members 18 and 20 are adjacent or otherwise near the edges 12 and 14 respectively.

A plurality of the holes 26 is formed in the building component 10*w*. The holes 26 are located to enable passage of a service through the building component 10*w* in a plane generally parallel to the first panel portion 16. Examples of a service may include electricity, water or gas. Thus the passage of the surface may involve the installation of pipes, conduits cables or wires to enable the flow of these services. In FIG. 1 for example one set of holes 26 is illustrated as enabling the passage of a pipe 28 that may enable with the flow of water through the building component 20*w*. A further set of holes 26 is illustrated as enabling the passage of an insulated cable 30 to enable the flow of electricity. The pipe 28 follows a linear path in a plane generally parallel to the first part of portion 16. The insulated cable 30, while following a bent or right angled path, nevertheless still enables or facilitates passage of a service, namely electricity in a plane generally parallel to the first panel portion 16.

Figure 12:
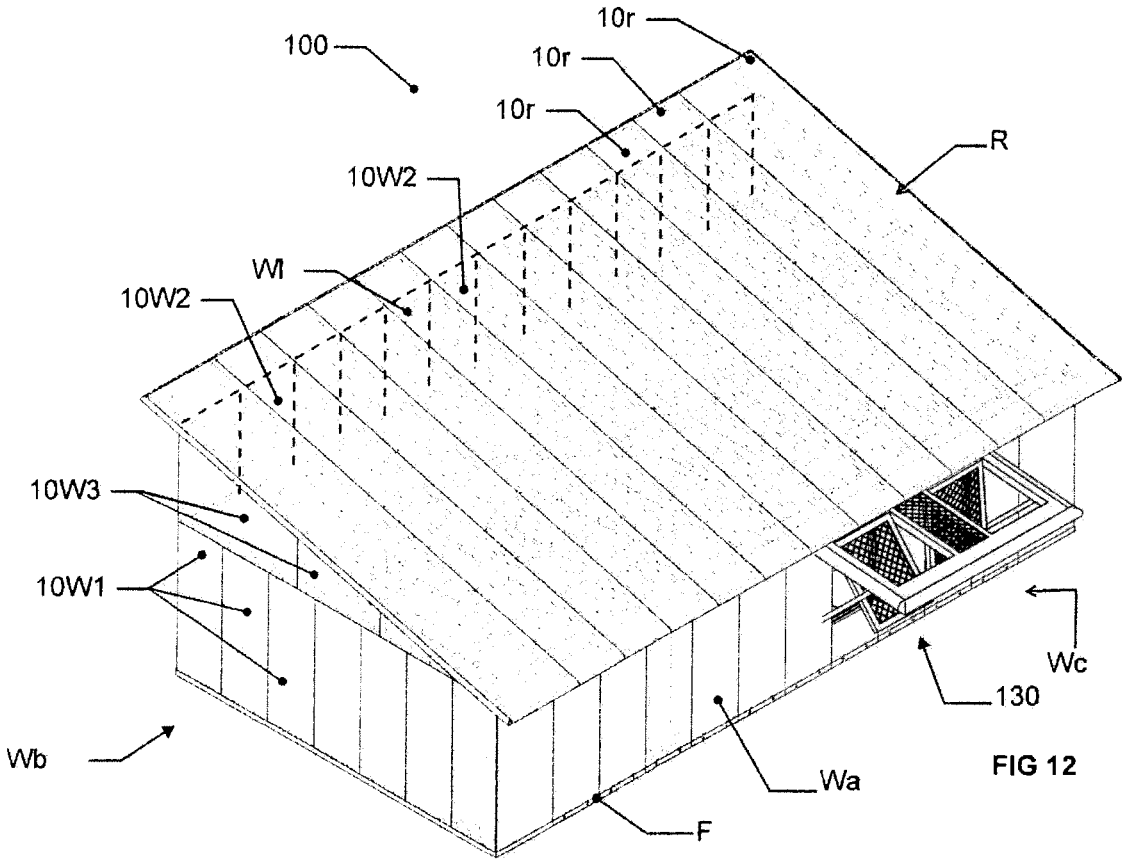
FIG. 12 is a schematic perspective view of a building constructed using embodiments of the disclosed building component including wall, floor and roof panels described above and in addition incorporating embodiment of a disclosed awning.

In a constructed building for example as shown in FIGS. 3 and 12 when a plurality of panels 10*w* are joined together at least some of the holes 26 of different adjacent panels are in registration with each other enabling the continued passage of the services through the plurality of joined components.

FIG. 2 illustrates respective portions of two building components 10*w*, denoted here for convenience as 10*wa* and 10*wb*, disposed and joined side by side lying in a common plane. The components 10*wa* and 10*wb* are of identical construction. The edge 14 of component 10*wa* abuts the edge 12 of the component 10*wb*. Also the member 20 of component 10*wa* abuts the member 18 of component 10*wb*. In this specific embodiment, and as clearly shown in FIG. 2, each of the members 18 and 20 is hollow. The holes 26 of the components 10*wa* and 10*wb* are in registration across the joint interface. Therefore for example a pipe 28 can extend through respective holes 26 in the adjacent components 10*wa* and 10*wb*.

Returning to FIG. 1 the component 10*w* in this embodiment includes an additional member 32 located between and extending parallel to the members 18 and 20. Each of the members 18, 20 and 32 have generally the same exterior shape/configuration. However as explained later, at least the members 18, 20 may not have exactly the same exterior configuration due to the provision of complimentary coupling parts that extend along the members 18 and 20 and facilitate coupling of adjacent building components 10*w*.

First and second end walls 34 and 36 extend across and at opposite ends of the first and second members 18 and 20. The end walls 34 and 36 also extend across the opposite ends of the additional member 32 when present. When the building component 10*w* is used as a wall panel the end wall 36 is provided with drainage slots 38. One of the slots 38 is between the members 18 and 32 and another between the members 32 and 20. Each of the end walls 34 and 36 is provided with bolt sleeves 40 that extend in a direction generally parallel to the members 18 and 20.

The profile of the end walls 34 and 36 is such that they have a greater thickness adjacent the first panel of portion 16 and progressively reduce in thickness in a direction perpendicular to and away from the first planar portion 16. The bolt sleeves 40 are disposed in the thickest portion of the end of walls 34 and 36.

The building component 10*w* also comprises a second panel portion 42 which is demountably connected or coupled to the first panel portion 16 in a face to face relationship on the second side 24. As the members 18, 20 and 32 are also on the second side 24 this results in the second panel portion 42 overlaying and abutting at least the first and second members 18 and 20. Indeed the second panel portion 42 substantially closes the building component 10*w*.

In one embodiment the panel portions 42 can be demountably connected to the first panel portion 16 by mechanical fasteners such as screws. However in an alternate embodiment this may be achieved by use of mutually engageable parts on the first and second panel portions 16, 42. For example FIGS. 1 and 3 show mutually engagable parts in the form of rails 39 and hooks 41. The rails 39 extend between and supported by the members 18 and 20. The hooks 41 are on the inside surface of the second panel portions 42. The second panel portion is lifted to locate the hooks above corresponding rails 39 then lowered so that the hooks 41 sits on the rails 39 as shown in FIG. 3. To assist in locking the portions 16 and 42 together a locking strip 47 is locatable between an underside of a roof panel 10*f* and upper end of the wall panel 10*w*. This prevents lifting of the panel portion 42 in an upward direction and off of the engaged rails 39.

When the second panel portion 42 is demountably connected to the first planar portion 16 one or more (in this instance two) cavities 44 are created within the building component 10*w*. A first of the cavities 44 is created between the panel portions 16 and 42 and the members 18 and 32. A second of the cavities 44 is located between the panel portions 16 and 42 and the members 32 and 20.

To facilitate the easy coupling of the panel portions 16 and 42 and minimize the ingress of foreign material into the cavities 44 the surfaces 46 of the members 18, 20 and 32 that directly face the second planar portion 42 are each formed as planar surfaces that are substantially flush with each other.

The first coupling part in the form of a tongue 46 extends along the first edge 12. A second coupling part in the form of a complimentary groove 48 extends along the opposite edge 14. When a plurality of building panels 10 are coupled side by side, for example to form a wall or a floor, the tongue 46 of one building component 10 seats in and engages with the groove 48 of an adjacent component 10. This is depicted in FIG. 2. In applications where a plurality of the panels 10*w* are connected side by side or end to end with like components 10*w* the coupling parts may also extend along the end walls 34 and 36.

FIG. 1 depicts a tongue 46 extending along the end wall 34. This tongue 46 is also depicted in FIG. 3 where it engages in a groove alternative embodiment of the building component 10*r*. FIG. 3 also depicts a coupling part in the form of a groove 48 extending along the end wall 36. Here the groove 48 lays between the bolt sleeve 40 and drainage openings in the form of slots 38. Thus it will be recognized that when the coupling parts are provided they may be provided as one form of coupling part (i.e. a tongue 46) extending along two mutually adjacent side or edges of the component 10*w*, such as edge 12 and wall 34; and a second complimentary form of coupling part (for example a groove 48) extending along two further adjacent side or edges, in this instance edge 14 and the end wall 36.

A drip groove 50 is formed along each of the first and second members 18, 20. Moreover the groove 50 extends about the peripheral surface of the building component 10*w* between the first and second panel portions 16 and 42. That is, the drip groove 50 extends along both of the edges 12 and 14 and along the end walls 34 and 36. The drip groove 50 is also located on a side of the tongues and grooves 46 and 48 closest to the second planar portion 42. This is most readily observed from FIGS. 2 and 3.

Figure 8:
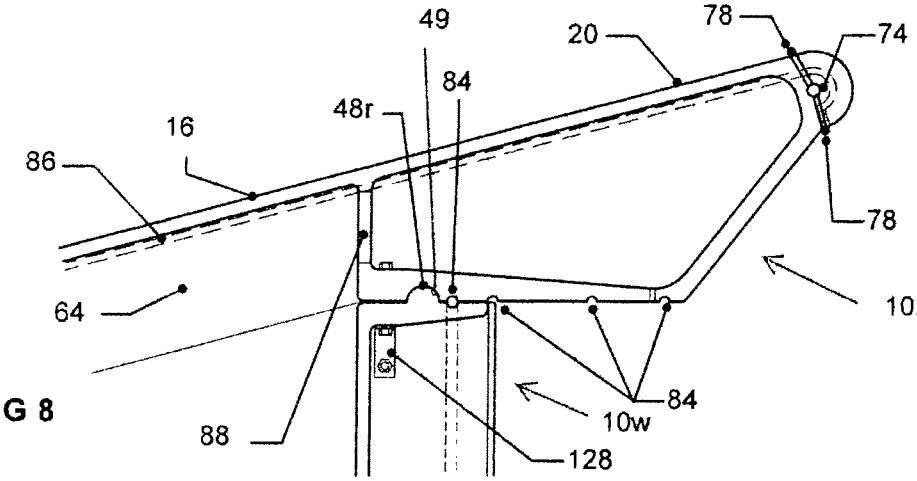
FIG. 8 is an enlarged partial section view of one end of the roof panel shown in FIG. 6 coupled to a wall panel of the type shown in FIG. 1.

An anti-capillary groove 49 is formed the building panel 10 to assist in preventing passage of water by capillary action between connected building components 10. FIG. 2 shows the anti-capillary groove 49 between two connected wall panels 10*w*. In FIG. 2 the anti-capillary groove 49 is located near a corner formed between the tongue 46 and the planar part of the member 12. FIGS. 3 and 8 shows an anti-capillary groove on the tongue 46 of a wall panel 10*w* connected to a roof panel 10*r*. In these embodiments the anti-capillary groove is located on a side of the tongue closest to the second planar portion 42.

The exposed planar surfaces of either on one of both the first and second planar portion 16 and 42 may be embossed or have otherwise applied thereto a decorative image, texture or indicia. Additionally a fire proof or fire retarding coating can be applied to one or both of these surfaces. Indeed the material from which at least the one or both of the first and second panel portions 16 and 42 is made may itself be fire proof or resistant. This is an inherent property of GRC mentioned above as a material from which each of the components 10 can be made.

Figure 5:
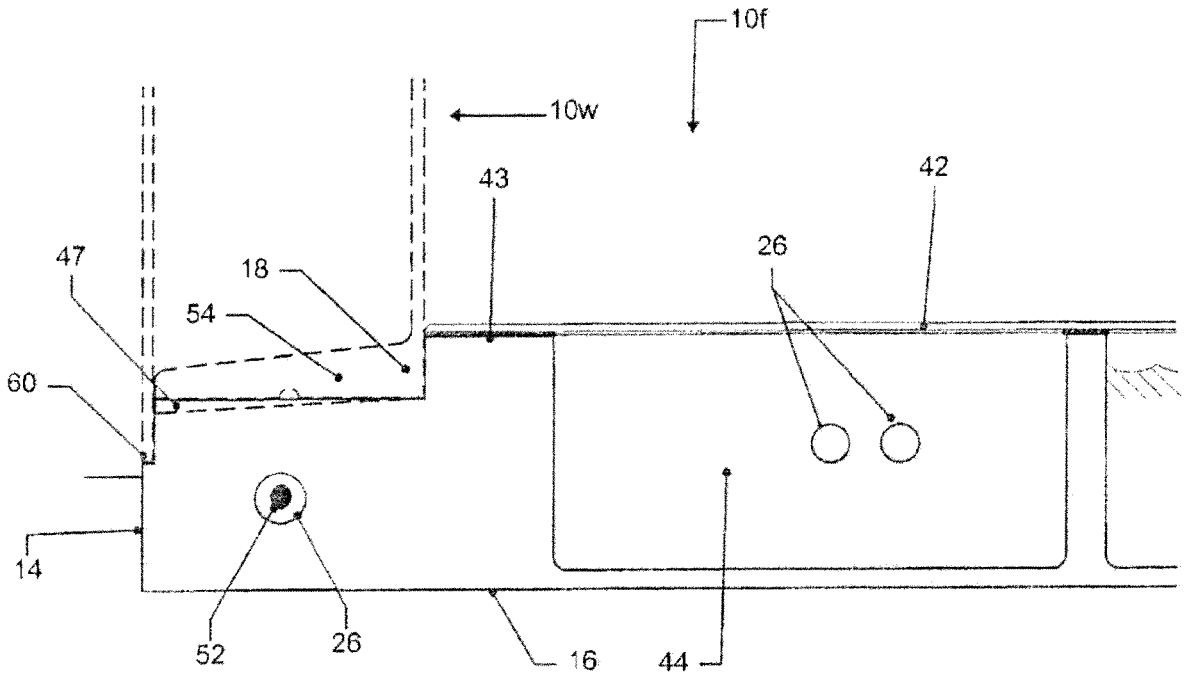
FIG. 5 is a section view of the floor panel shown in FIG. 4 in juxtaposition with a wall panel as shown in FIG. 1.
Figure 4:
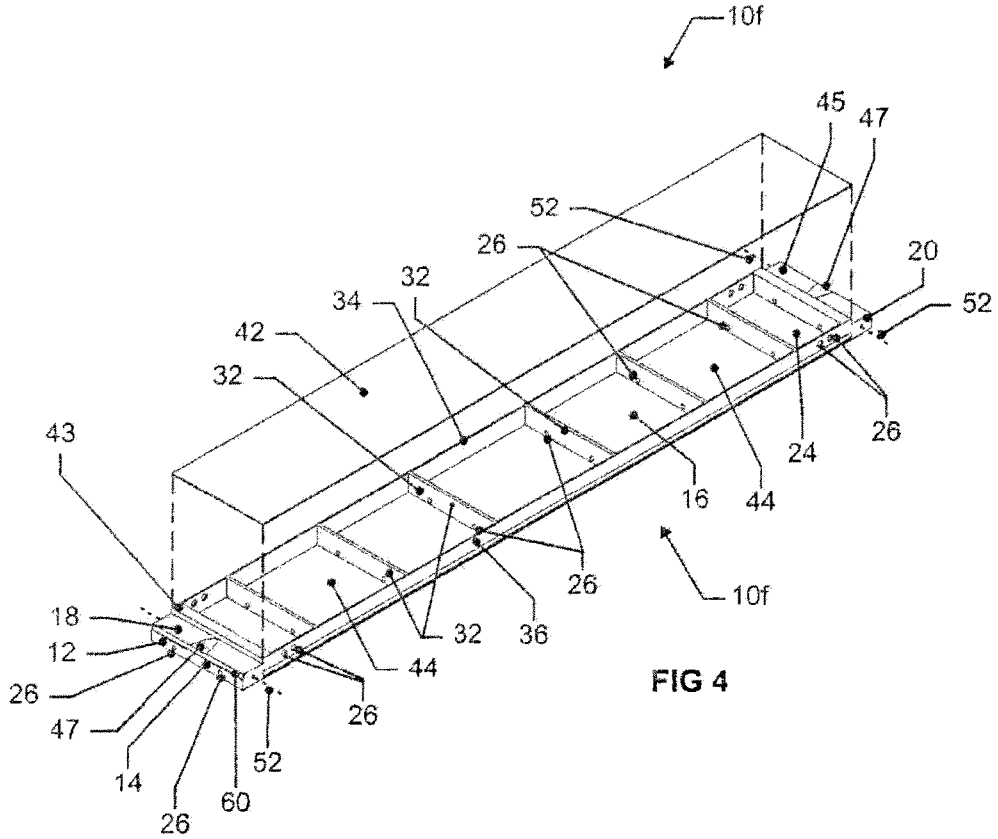
FIG. 4 is an exploded perspective view of a third embodiment of the disclosed building panel, this embodiment being in the form of a floor panel.
Figure 6:
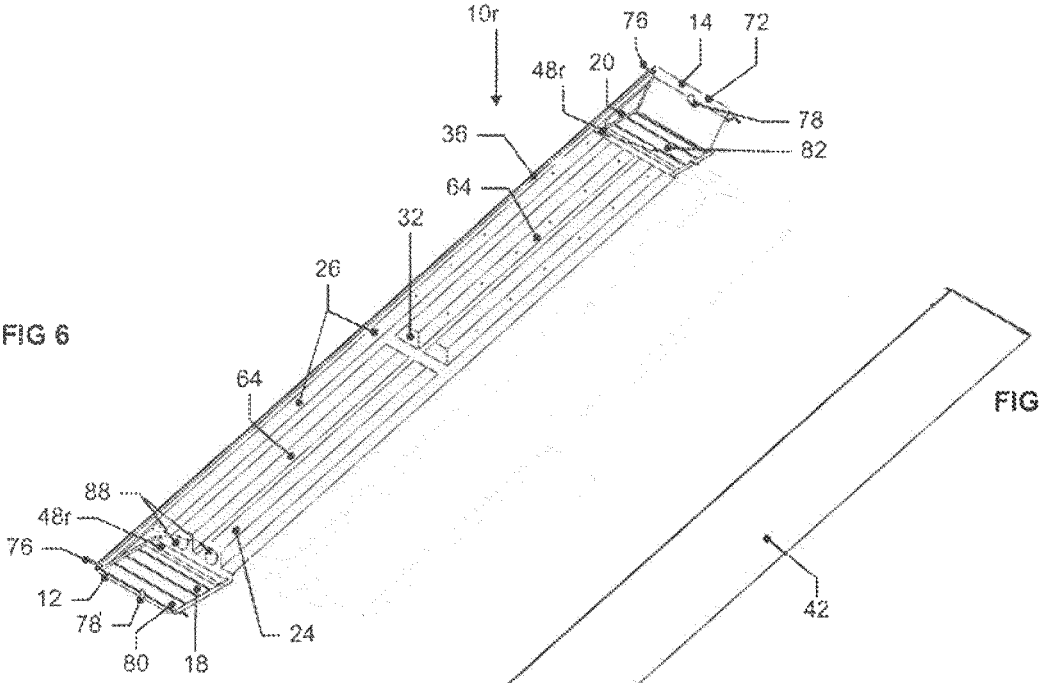
FIG. 6 is a perspective representation from the underside of the wall panel shown in FIG. 3.

FIGS. 4 and 5 depict an embodiment of the building component 10*f* which may be utilized as a floor panel for a building. The building component 10*f* has a similar basic construction to the component 10*w*. To this end the reference numbers used to denote various features of the component 10*w* will also be used to denote the same or similar features of the building component 10*f*.

The building component 10*f* comprises opposite first and second edges 12 and 14, a first planar portion 16 and first and second members 18 and 20. The members 18 and 20 extend along the edges 12 and 14 respectively. In the present embodiment of the building component 10*f* however the members 18 and 20 are solid rather than hollow as in the building component 10*w*. A further minor different between the components 10*w* and 10*f* is the disposition of the edges 12 and 14. These edges are disposed along the longest sides of component 10*w*; while in the building component 10*f* the edges 12 and 14 run along its shorter sides.

The component 10*f* also comprises a plurality of holes 26 to enable the passage of services or other articles through the component 10*f* in a plane generally parallel to the first planar portion 16. The services that may pass through the holes 26 include for example water, gas and electricity. Water and gas services will be contained within conduits or tubes that pass through the holes 26. Electricity will be contained within cables or wires that pass through the holes 26. In addition however, the holes 26 may accommodate other articles such as high tension steel cables 52. Such cables can be threaded through the holes 26 formed in the members 18 and 20 of mutually adjacent panels 10*f* to enable mechanical coupling of the building components 10*f*. Thus a plurality of the panels 10*f* can be laid side by side with their respective members 18 and 20 aligned and subsequently mechanically held together by cables that pass through mutually registering holes 26. The cables 52 may then be subsequently tensioned to a prescribed load to resist lateral separation of adjacent building components 10*f*. This also provides integrity to a floor constructed from such a plurality of building components 10*f*. Building component 10*f* also includes end walls 34 and 36 that extend between and at opposite ends of the first and second members 18 and 20.

The component 10*f* also comprises a second planar portion 42 demountably coupled to the first panel portion 16 in a face to face relationship and on the second side 24 of the first panel portion 16. A rebate 54 is formed on each of the members 18 and 20 to seat the components 10*w*. The rebates 54 results in the members 18 and 20 have relatively raised faces 43 and 45 respectively. The second panel portion 42 extends at least partially across both of the members 18 and 20 up to an end of and covering the faces 43 and 45. Additionally the second panel portion 42 sits on and covers the side walls 34 and 36. Accordingly the building component 10*f* comprises a plurality of cavities 44 located between the first and second panel portions 16 and 42 and the members 18 and 20. Drainage slots 47 are formed in the rebates 54 to facilitate draining of water from between the components 10*f* and 10*w*.

Building component 10*f* comprises a plurality of additional members 32 that extend parallel to and between the members 18 and 20. The members 32 however in this embodiment are in the form of planar walls or webs. The members 32 provide additional support for the second panel portion 42 which may form a floor or a floor substrate when the building component 10*f* is used as a floor panel.

Respective seats 60 are rebated in the members 18 and 20 along and on a side adjacent to the respective edges 12 and 14. As explained in greater detail hereinafter the seats 60 may be arranged to seat an extension strip 61 (shown in FIG. 3) of a panel portion 42 of the building component 10*w*. When utilized for this purpose the seat 60 is configured so that when the extension strip 61 is received therein a free face of the panel 42 lies substantially flush with the respective edges 12 and 14 of the building component 10*f*.

When the building component 10*f* is used as a floor panel the cavities 44 may be filled with material to provide weight to resist uplift of a corresponding building. For example the cavities 44 may be filled with concrete, or water. In use however the cavities 44 if filled with such materials will be filled after the installation of various services through the holes 26. Of course if a liquid is used for the provision of additional weight in any particular cavity 44 then the portion of the members 18, 20 or 32 that bound that cavity would not be provided with any holes 26, or if such holes are provided, the holes are plugged or otherwise closed to avoid escape of the liquid. Some of the cavities may also: accommodate services such as air conditioning equipment and ducting; or house generators or batteries. When the cavities hold liquid such as water this may also be used for evaporative air conditioning.

The above also facilitates the use of one or more of the cavities 44 to store rainwater that may be used as a grey water source for a building constructed using the building components 10*f*.

FIGS. 6-10 depict a further embodiment of the building component designated 10*r*. The building component 10*r* is of the same general form as the building components 10*w* and 10*f* but is specifically configured for use as a roof panel for a building. Features of the building component 10*r* that are similar in form or function to those described in relation to the building components 10*w* and 10*f* will be denoted with the same reference numbers.

The building component 10*r* comprises first and second edges 12 and 14, a first planar portion 16 and first and second members 18 and 20 respectively. The members 18 and 20 in this embodiment of the building component 10*r* are hollow as per the members 18 and 20 in the building component 10*w*. However the members 18 and 20 in the building component 10*r* have a different profile as most clearly seen in FIG. 8 to those of the building component 10*w*. The first planar portion 16 has opposite sides 22 and 24. The side 22 constitutes an exterior or weather side of the building component 10*r*. The side 24 faces towards an interior of a building having a roof constructed from a plurality of building components 10*r*.

The building component 10*r* also includes end walls 34 and 36 that extend between the members 18 and 20. A further member 32 lies parallel to the members 18 and 20 and is coupled to each of the end walls 34 and 36. The additional member 32 is of a different profile to the members 18 and 20. In particular the additional member 32 has a rectangular profile. The member 32 may be hollow or solid.

The building component 10*r* also includes strengthening beams 64. Two beams 64 are shown in alignment with each other. The beams 64 are disposed between and parallel to the end walls 34 and 36. One of the support beams 64 extends between and is attached to the first member 18 and the additional member 32. The other support beam 64 extends between and is attached to the additional member 32 and the second member 20.

Figure 9:
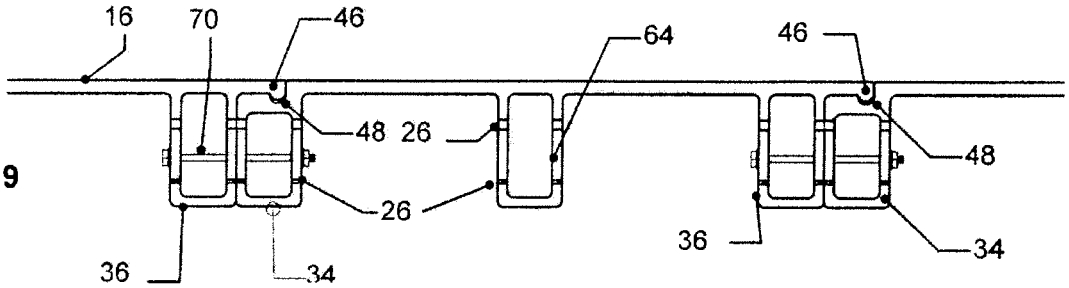
FIG. 9 is a section view of two roof panels joined side by side.

As shown most clearly in FIG. 9, the end walls 34 and 36 as well as the beams 64 each have a rectangular profile. Further, each the end walls 34 and 36 and the beams 64 of in this embodiment is hollow.

The building component 10*r* is provided with a plurality of holes 26 to enable the passage of services and/or other articles through the building component 10*r* and indeed through a plurality of adjacent building components 10*r*. For example tubes, pipes or cables may pass through the holes 26 to enable the flow of services such as water, gas, electricity and telecommunications. Additionally, the holes 26 may be used for mechanical fasteners such as bolts 70 (see FIG. 9) for mechanically connecting adjacent building components 10*r* together in a side by side relationship so that their respective planar portions 16 form a substantially continuous outside or weather surface. Additionally or alternately cables (not shown) can be passed through registering holes 26 of adjacent components 10*r* to couple the components together. In such instance the cables can be tensioned to a prescribed tensile load.

With particular reference to FIG. 9 it will also be seen that the building component 10*r* comprises complimentary coupling parts in the form of a tongue 46 and a groove 48. The tongue 46 depends from the surface 24 on the first planar portion 16 along an edge adjacent the end wall 36. The groove 48 runs along and is formed as a channel in the end wall 34. When a plurality of building components 10*r* are joined side by side the tongue 46 of one building component seats in the groove 48 of an adjacent building component. In this embodiment the groove 48 may be formed of a depth greater than that required to seat the tongue 46. In this way the groove 48 also doubles as a drainage channel for any water that may seep between joined building components 10*r*.

Each of the members 18 and 20 is formed with a thickened portion 72. The portion 72 extends for the width of the members 18 and 20 respectively. A through hole 74 extends through the thickened portion 72. The hole 74 is configured to enable the passage of water. This may be by virtue of providing a water proof lining or coating to the surface of the hole or by insertion of a water pipe 76 (shown in FIGS. 6 and 7). When a plurality of the building components 10*r* are joined side by side the holes 74 are in mutual alignment. A water pipe 76 can then be passed through the aligned holes 74. Alternately each component 10*r* may be provided with connectors to enable water tight connection between the holes 74 to create a continuous water path or channel along a roof structure made from a plurality of roof panels 10*r*.

Figure 11:
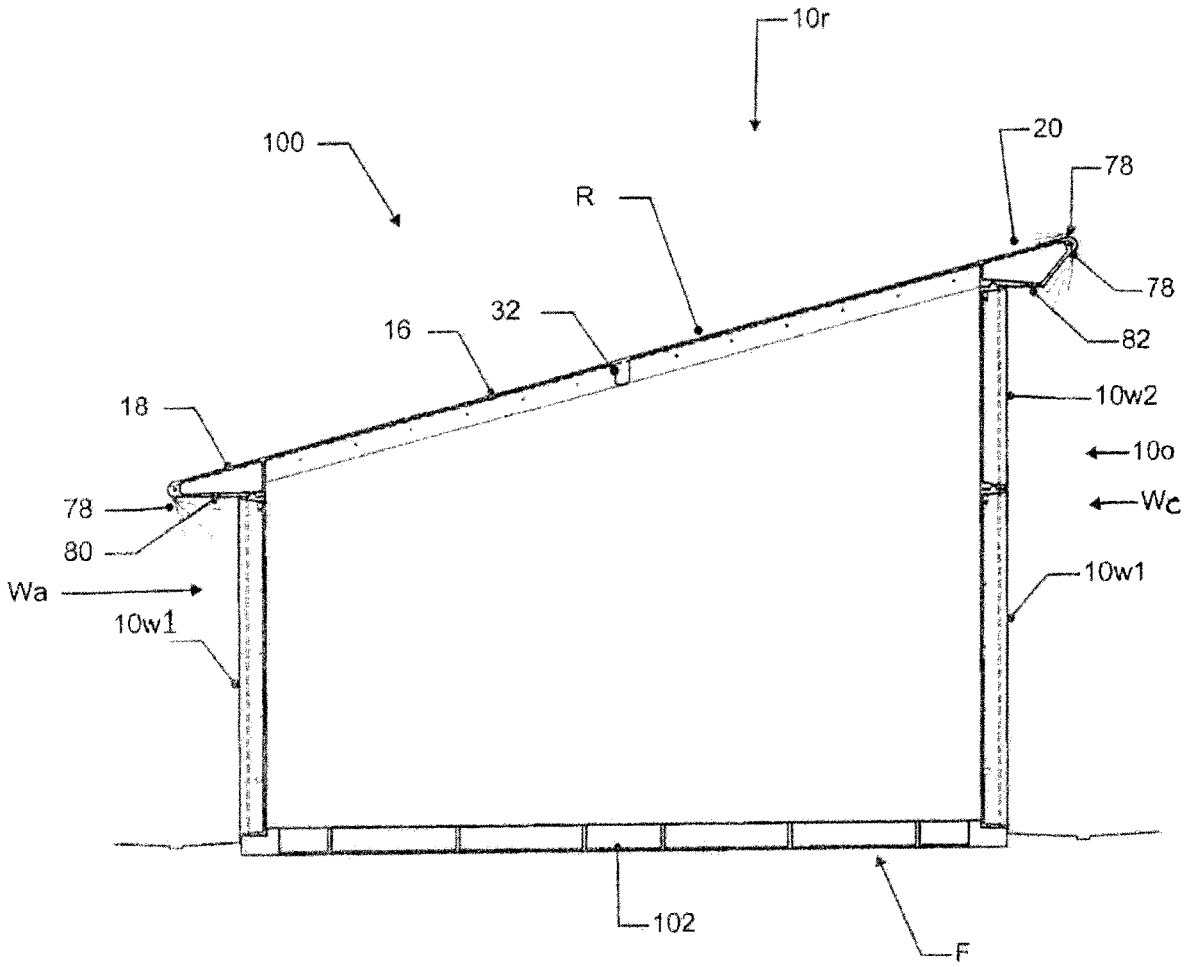
FIG. 11 is a section view of a building constructed incorporating embodiments of the disclosed building panel including wall panels in accordance with FIG. 1, floor panels in accordance with FIGS. 4 and 5 and roof panels in accordance with FIGS. 6-10.

Sprinklers 78 may be attached to a building component 10*r* on one or both of the members 18 and 20 to enable fluid communication with water flowing through the holes 74 and/or pipes 76, when provided. Thus when water is caused to flow through the holes 74 the water is sprayed from the sprinklers 78. As depicted in FIG. 11 the sprinklers 78 may be positioned so as to direct the spray onto walls of an associated building and indeed onto surface 22 of the first planar portion 16 of the components 10*r* and/or 10*f*. This may provide protection to the associated building in the event of a fire.

It will be noted that the profile of the first member 18 is different to that of the second member 20. This difference in profile arises when the building component 10*r* is used as a roof panel for a pitched or inclined roof as depicted in FIG. 11. When used in this manner an under surface 80 of the member 18 and undersurface 82 of the member 20 lie in substantially horizontal but vertically spaced apart planes. Each of the under surfaces 80 and 82 is formed with a plurality of longitudinally extending and spaced apart drip grooves 84.

One or more drainage openings in the form of weep holes 86 may be formed in the under surfaces 80 and 82 of the members 18 and 20. The weep holes 86 enable condensate formed within the members 18 and 20, or indeed liquid that may seep into the members 18 and 20, to drain therefrom. Undersurfaces 80 and 82 are also provided with coupling parts in the form of grooves 48*r* to locate with and receive a tongue 46 of an underlying building component 10*w*. This is depicted for example in FIGS. 3 and 8. To enable the use of mechanical fasteners such as bolts to fix a building component 10*r* to an underlying building component 10*w*, access openings 88 can be provided into the voids of the members 18 and 20. The access openings 88 are accessible from the side 24 of the planar portion 16 and between the end walls 34 and 36.

Figure 10:
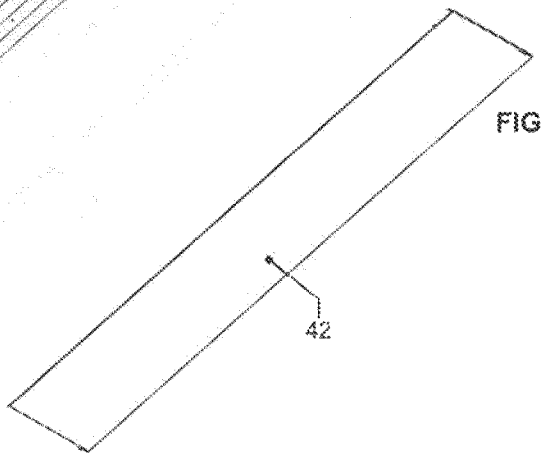
FIG. 10 is a perspective view of an optional panel that may be incorporated in the roof panel shown in FIGS. 3 and 6-9.
Figure 7:
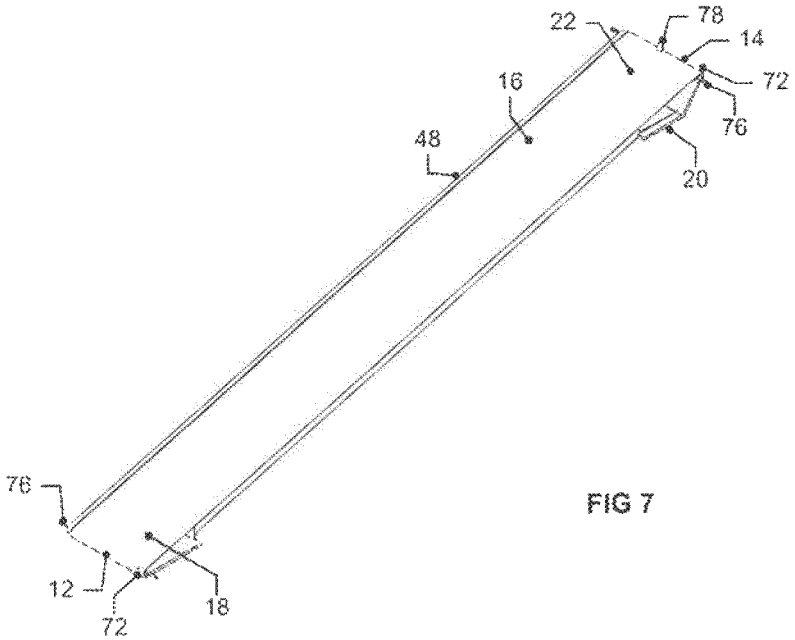
FIG. 7 is a perspective representation from the top side of the roof panel shown in FIGS. 3 and 6.

FIG. 10 depicts an optional second planar portion 42 which may be incorporated in various embodiments of the building component 10*r*. The planar portion 42 can be connected demountably to the first planar portion 16 by use for example of screws that pass through the portion 42 and into the first and second members 34, 36, the beams 64 and/or the additional member 32. The second planar portion 42 is configured to wholly overlie and span across the end walls 34 and 36 and between the first and second members 18 and 20. In this way the second planar portion 42 may act as a ceiling panel for the interior of a building which utilizes the components 10*r* in the fabrication of its roof.

FIGS. 11 and 12 provide a schematic representation of a building 100 constructed using a plurality of the building components 10*w*. The building 100 has four exterior walls Wa, Wb, Wc and Wd; and a roof R. The wall Wa is constructed from building components 10*w*1 only. The walls Wb, Wc and Wd are constructed form a combination of components 10*w*1, 10*w*2 and 10*w*3. The roof R is constructed from a plurality of the building components 10*r*. In this embodiment the building 100 sits on a floor slab F formed by a plurality of the floor panels 10*f* described in relation to FIGS. 4 and 5 above. It should however be recognized that a building can be constructed with only one or two of the floor slab, walls and roof being fabricated from corresponding building components 10*f*, 10*w* and 10*r*; with the remaining parts of the building being fabricated using conventional methods and materials. For example one may erect a building having walls Wb, Wc and Wd constructed form a combination of components 10*w*1, 10*w*2 and 10*w*3, and a roof R constructed from a plurality of the building components 10*r* but sitting on a conventional poured concrete pad and footings.

The panels 10*w*1 and 10*w*2 are substantially identical except for the following. The panels 10*w*2 are shorter in height than the panel 10*w*1. Further, the second planar portions 42 of the wall panels 10*w*1 are provided with the extension 61 that extend down the sides of the footings 104. This feature is depicted in FIG. 3. This provides a barrier to the ingress of water from beneath the wall panels 10*w*1. As a consequence of this extension 61, the second planar portions 42 in the component's 10*w*1 are longer than the corresponding first planar portions 16.

The panel 10*w*3 differs from the panel 10*w*1 by being shorter in height and greater width than the panel 10*w*1. Further in order to take account of the inclination of the roof R the panels 10*w*3 have an inclined upper end wall. Thus the panels 10*w*3 have a non-rectangular quadrilateral shape.

In constructing the building 100 the panels 10*w*1 are bolted to the members 18 and 20 of the floor panels 10*f* which constitute the slab F. Additionally the panels 10*w*1 are abutted side by side so that their respective coupling parts in the form of tongues 46 and grooves 48 engage each other. In this way a plurality of the wall panels 10*w*1 (and 10*w*2) can form exterior and indeed interior walls of the building 100. A plurality of wall panels 10*w*2 are connected to and immediately above wall panels 10*w*1 on the wall Wc. Consequently the wall Wc has a greater height than to wall Wa. Accordingly when the roof panels 10*r* are coupled between the respective walls Wa and Wc the panels 10*r* are inclined or pitched. The roof panels 10*r* can be fastened to immediately underlying wall panels 10*w*1 or 10*w*2 via mechanical fasteners such as bolts and/or mounting brackets. Panels 10*w*3 are connected to and immediately above wall panels 10*w*1 on the walls Wb and Wd to close the otherwise open space between the inclined roof R and the panels 10*w*1 of these walls. During construction of walls using the wall panels 10*w*1, 10*w*2 and 10*w*3 the respective second planar portions 42 are conveniently decoupled. This enables ready access to the interior of the panels 10*w*1, 10*w*2 and 10*w*3 for the feeding through and connection of various services via the holes 26. Once all of the services have been connected and tested the corresponding second planar portions 42 may be fitted to their respective panels 10*w*1, 10*w*2 and 10*w*3.

With particular reference to FIG. 3 when erecting the wall panels 10*w*1 on the floor slab F (or indeed on a conventional floor slab) an intervening sill tray 106 can be installed to assist in controlling or directing water away from the floor slab F and interior of the building 100. The sill tray 106 may be in the form of a thin metallic plate having a length that may span the entirety of the length of the wall W fabricated from a plurality of wall panels 10*w*1. The sill tray 106 has a plate portion 108 that is disposed between the end walls 36 of wall panels 10*w*1 and the floor slab F. The plate portion 108 has an intermediate upstanding ridge 110. The ridge 110 is configured to locate within the groove 48 formed in the end walls 36. Parallel to but spaced from the ridge 110 is a locating V crimp 112. This is formed as a relatively shallow crimp or bend in the plate 108 so as to protrude on a side opposite to that of ridge 110. The V crimp 112 can be used to assist in locating mechanical fasteners such as screws to screw the sill tray 106 onto the underlying floor slab F. The sill tray 106 is formed with a forward edge 114 and a downwardly depending flange 116. When the sill tray 106 is in use the corner formed below the edge 114 between the flange 116 and the plate 108 can sit on or alternately extend slightly beyond an upper corner 118 of the floor slab F. A right angle lip 120 extends laterally from the flange 116 in a direction away from the slab F. Drainage slots 122 are also formed at spaced apart locations along the sill tray 106 extending transversely between the V crimp 112 and the edge 114.

During construction of the building 100 the wall panels 10*w*1 and the sill trays 106 are juxtaposed so that the ridge 110 seats in a tongue 48; the V crimp 112 is disposed in substantial alignment with the drip groove 50 running along the end wall 36, and the flange 116 and lip 120 are disposed so as to seat the lower strip 61 of the second planar portions 42. By virtue of this arrangement any liquid or moisture in the drip groove 50 is directed to flow to the V crimp 112 subsequently through the drainage slots 122 and thus be directed to the outside of the building 100.

Once the walls W have been erected, the roof R can be fabricated in-situ by sequentially lifting and placing respective roof panels 10*r* on the erected walls W. As shown in FIG. 11 the tongues 46 on the end walls 34 locate within grooves 48 formed in the under surfaces 80 and 82 of the roof panels 10*r*. Subsequently, bolts or other mechanical fasteners can be passed through holes on the inside of the under surfaces 80 and 82 (accessed via the access openings 88) and passed through the bolt sleeves 40 in the underlying wall panels 10*w*. The bolts may then be fastened by application of nuts 126 (see FIG. 3) which can be applied prior to coupling of second planar portions 42 with the corresponding first planar portion 16 of an associated wall panel 10*w*. Optionally, U brackets 128 may also be installed in the wall panels 10*w* so as to receive the aforementioned bolts and also provide additional tie down strength between the roof panels 10*r* and the wall panels 10*w*.

Figure 13:
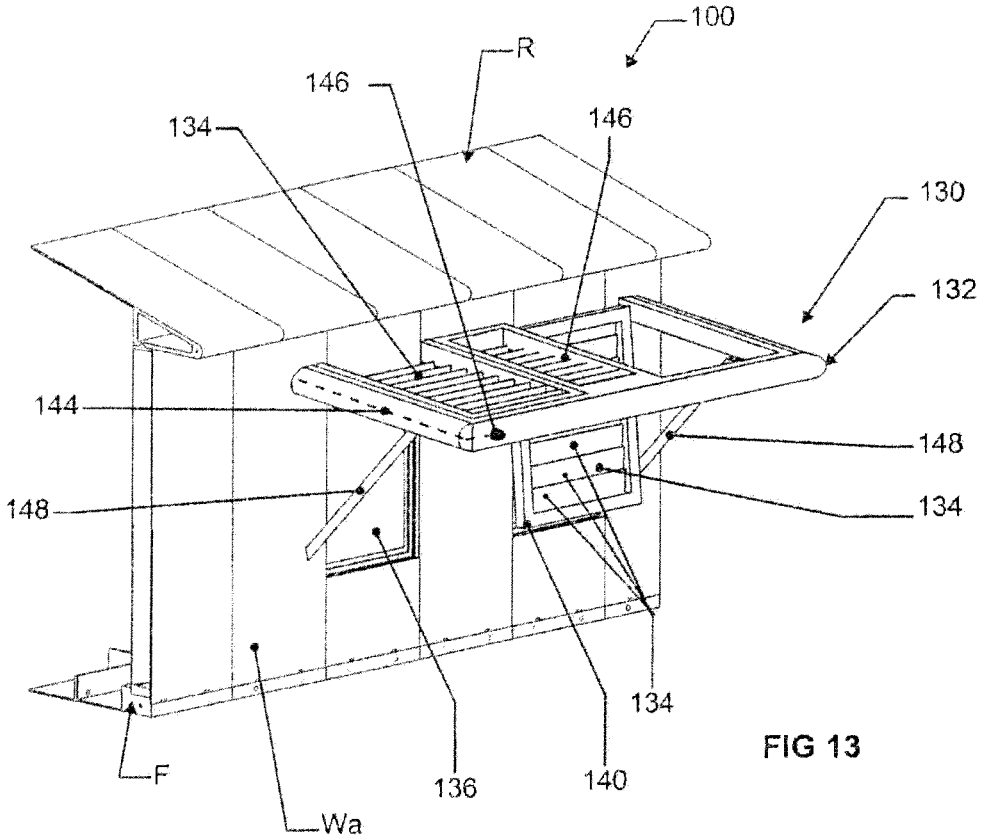
FIG. 13 is an enlarged schematic representation of a second embodiment of the disclosed awning.
Figure 14:
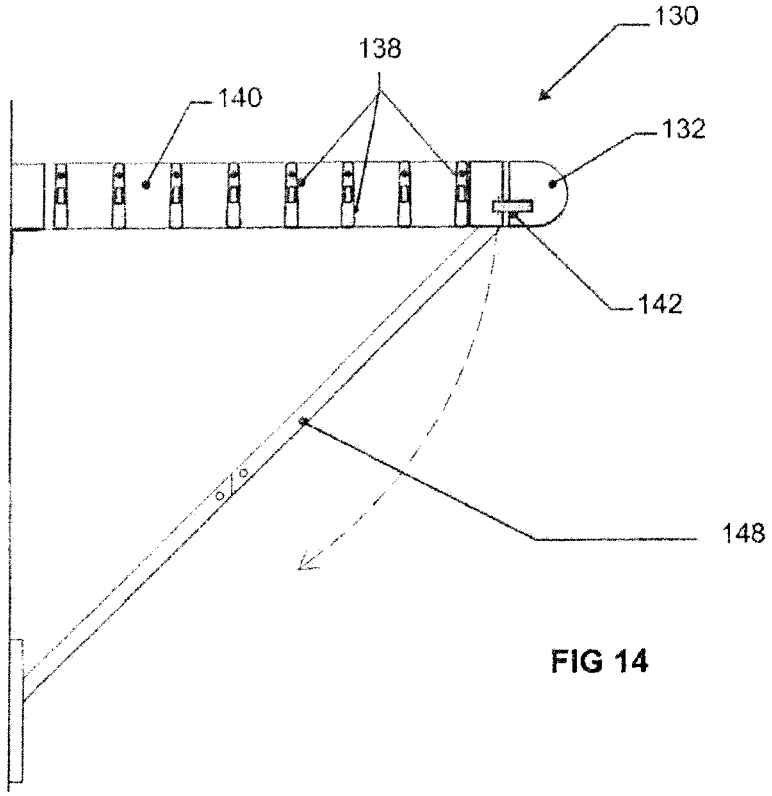
FIG. 14 is a section view of the awning shown in FIG. 13.

FIGS. 13 and 14 depict an awning 130 which may be utilised with a building 100 constructed from one or more types of building components 10. Indeed, the awning 130 may also be utilised with a conventional building which does not incorporate any of the building components 10. The main function and purpose of the awning 130 is to provide shade to a surface portion of the building and in particular but not limited to a window; and to also provide physical protection from external force or impact such as for example: wind pressure or debris carried by wind as may occur for example in the event of a hurricane or cyclone, or in a firestorm; and hail stones.

The awning 130 comprises a frame 132 and one or more (in this instance two) shade members 134. The shade members 134 are pivotally coupled to the frame 132 and movable between a shading position and a protecting position. In FIG. 13 the shade member 134 on the left hand side is depicted in the shading position while the shade member 134 on the right hand side is depicted in the protecting position. The shading position is characterised by the shade member 134 being angularly spaced from a portion on a surface of the building 100. In this instance, the portion of the building surface is constituted by a window 136. The protecting position is characterised by the shade member 134 overlying in substantial parallel relationship with the surface 136.

Thus in the event that the frame 132 is erected so as to extend in a plane perpendicular to the surface 136 then the shading position corresponds with the shade members 134 being substantially coplanar with the frame 132 and the protecting position corresponds with the shade members 134 being substantially perpendicular to the frame 132. However, there is no requirement or necessity for the frame 132 to lie perpendicular to the surface 136. For example the frame 132 may be angularly spaced by say 60° from the surface 136.

In this embodiment each shade member 134 comprises a plurality of louvers 138 and a peripheral frame 140. Each louver 138 is pivotally supported on the peripheral frame 140. The louvers 138 are arranged so that their pivotal attachment to the peripheral frame 140 has the effect of always hanging the louvers 138 to lie in vertical planes. Thus, each level 138 hangs substantially vertically irrespective of the disposition of its corresponding peripheral frame 140. Accordingly when the shade member 134 is in the shading position the louvers 138 are mutually spaced apart to provide gaps there between through which for example light can pass. This is shown most clearly in FIG. 14.

However when the shade member 134 is in the protecting position the louvers 138 overlap each other so as to in effect present a unified surface overlying the building surface 136. The nature of the overlap between the louvers 138 is such that an upper end of one louver overlies a lower end of an immediately higher louver when in the protecting position.

The awning 130 also comprises a latch 142 for releasably latching the shade members 134 in the shading position. The latch 142 can be released either manually, electronically, or both manually and electronically. For example the latch 142 may comprise a spring loaded pin that is biased so as to engage and hold a shade member 134 in the shading position. With a manual release system the pin may be coupled by a cable 144 to a lever or handle (not shown) internal of the building 100 that can be pulled or turned to release the pin thereby allowing the shade member 134 to be released from the frame 132 and move to the protecting position. Alternately, the pin may be activated by a solenoid so as to hold the shade member 134 in the shading position. The solenoid is connected via a cable 144 to a switch that enables deactivation of the solenoid allowing the pin to retract by action of a spring so as to release the shade member 134 from the frame 132. Of course both the electronic and manual release mechanisms may be provided so that the manual system may be used in the event of a failure or jamming of the electronic system. Further if an electronic release system is used it may be configured in a fail safe manner so that in the event that power is cut off from the building 100 the latch 142 automatically disengages allowing the shade member 134 to release from the frame 132 and pivot toward the protecting position.

It is envisaged that the peripheral frame 140 of the shade member 134 is made from a fibre reinforced cementitious material, for example GRC. The louvers 138 may be made from a metal or GRC. Thus when such a shade member is released from the shading position and particularly in high wind conditions the shade member 134 may pivot or swing toward the protecting position at substantial speed and therefore with relatively high momentum. In order to control the motion of the shade member and in particular to minimise or avoid substantial impact a dampening hinge system is provided between the shade member 134 and the frame 132.

In this embodiment the frame 132 incorporates a central support portion 146 which is also configured to provide shade to the surfaces 136 when for example the sun is at an oblique angle to the surfaces 136. In this embodiment this is achieved by forming the support portion 146 with a plurality of louvers 138. These louvers may be fixed or hinged. However in an alternate embodiment the support portion 146 may be in the form of a simple beam. Dependent on the width of the beam, the shade members 134 may be increased in width so that when in the shading position the shade members 134 and the beam together fully occupy the area bound within the frame 132. In yet a further embodiment a single shade member 134 may be provided that extends wholly across the frame 132. In that event, there will be no central supporting portion 146. Spars 148 provide additional support for the frame member 132. The spars 148 extend diagonally and are attached at opposite ends to the frame 132 and the building 100.

Figure 15:
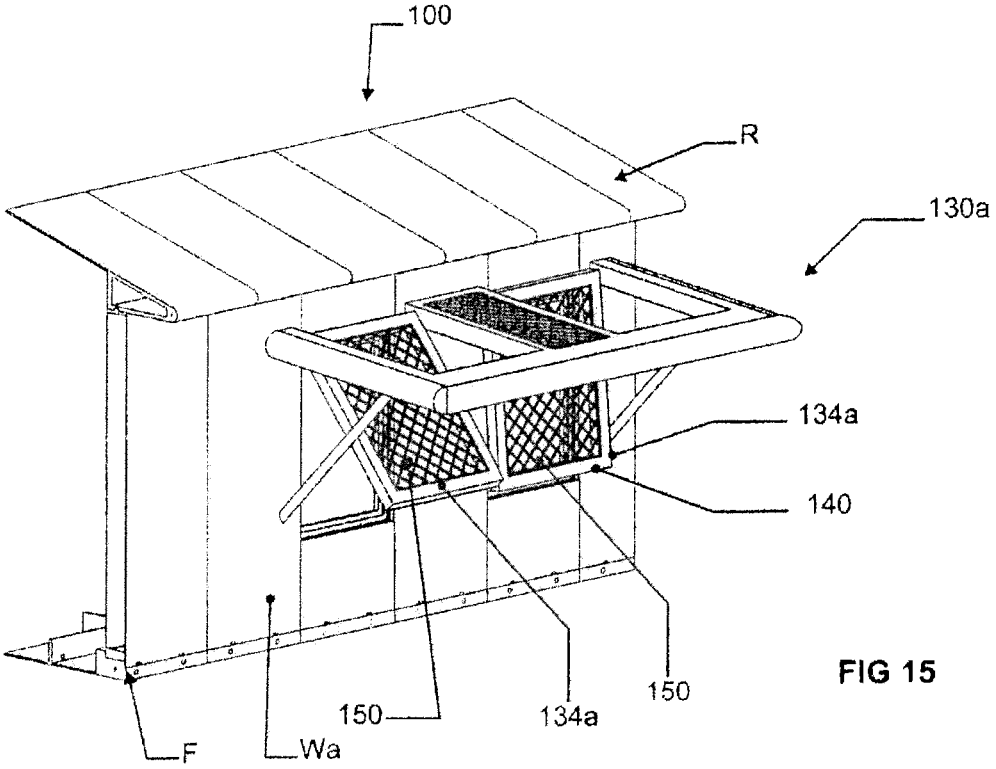
FIG. 15 is a schematic representation of the embodiment of the awning shown in FIG. 12.

FIG. 15 depicts an alternate form of the awning **130*a*. The awning 130*a* FIG. 15 differs from that in FIGS. 13 and 14 solely by replacement of the louvers 138 with metallic mesh 150. Thus in the awning 130*a* of FIG. 15 each shade member comprises a peripheral frame 140 together with a fixed metallic mesh 150 extending across and retained by the peripheral frame 140. It will be recognised that in this configuration the shade members 134*a* provide less or different shade to the shade members 134 when in the shading position. Also, when in the protecting position, the shade members 134*a* provide impact protection to the extent that no object is able to pass between the interstices of the mesh 150**.

Each of the shade members 134 and **134*a* may be used in the protecting position simply as a security screen against unauthorised entry or break in. In this event a corresponding latching system may be provided to retain the shade members in the protecting position so that they cannot be pivoted upwardly to enable forced entry through the surface 136**.

Whilst specific embodiments have been described it should be appreciated that the disclosed building component may be embodied in many other forms. For example with particular reference to the building component shown in FIG. 1 one or more diagonal members or cross braces may be provided extending between and coupled to the members 18 and 20. In such an embodiment the additional member 32 may be retained or alternately may be deleted. The diagonally extending members or braces can for example extend between the respective corners of the component 10 formed by the members 18 and 20 and the end walls 34 and 36. The building components 10 may be made from a light weight fibre cement material. Such materials offer fire resistance and substantial compressive strength. Using such material enables the components 10 to be made by a casting or moulding process. A building constructed utilising the components 10 and the awning 130 may be automated to enable remote activation of various safety and security systems. For example a building may include: computer or otherwise remotely controlled actuators for activating the sprinklers 78 and closing the awning 130. Additionally or alternately the building may comprise local sensors to automatically activate the sprinklers 78, and local sensors to automatically close the awning 130.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the building components and awning as disclosed herein.

The invention claimed is:

1. A load bearing building component comprising:

a first panel portion having:

first and second parallel and spaced apart edges;

first and second opposite sides; and at least first and second members each located on the second side of the first panel portion, wherein the first and second members extend along the first and second edges respectively, wherein the first panel portion is a single cementitious product inclusive of the at least first and second members and is made by a casting or moulding process; and a second panel portion demountably coupled to the first panel portion in a face to face relationship on the second side of the first panel portion;

wherein the first panel portion has: a tongue along the first edge and a groove along the second edge, wherein said load bearing building component is configured to be connected adjacent an identical building component such that the tongue of said load bearing building component can seat within the groove of the other identical building component; and a drip groove extending along at least both of the first and second edges and located on a side of the tongue and groove closest to the second panel portion; and mutually engageable parts on the first and second panel portions arranged to enable the demountable coupling of the first and second panel portions, the mutually engageable parts comprising one or more rails on one of the first and second parts and one or more hooks on another of the first and second parts.

2. The building component according to claim 1 wherein the one or more rails extend between and are supported by the first and second members.

3. The building component according to claim 1 wherein the drip groove is formed continuously about a peripheral surface of the first panel portion.

4. The building component according to claim 1 comprising an anti-capillary groove capable of assisting in preventing passage of water by capillary action between connected building components.

5. The building component according to claim 1 comprising a plurality of holes located to enable passage of a service or article through the component in a plane generally parallel to the first panel portion.

6. The building component according to claim 1 wherein the building component comprises first and second end walls that extend between and located at opposite ends of the first and second members.

* * * * *